US009272408B2

(12) United States Patent
Koch et al.

(10) Patent No.: US 9,272,408 B2
(45) Date of Patent: Mar. 1, 2016

(54) HAND-HELD MACHINE TOOL

(75) Inventors: Olaf Koch, Kaufering (DE); Matthias Keith, Kaufbeuren (DE); Dieter Kraus, Schwabmunchen (DE); Ali Shadavakhsh, Munich (DE)

(73) Assignee: HILTI AKTIENGESELLSCHAFT, Schaan (LI)

( * ) Notice: Subject to any disclaimer, the term of this patent is extended or adjusted under 35 U.S.C. 154(b) by 196 days.

(21) Appl. No.: 13/297,782

(22) Filed: Nov. 16, 2011

(65) Prior Publication Data

US 2012/0125650 A1 May 24, 2012

(30) Foreign Application Priority Data

Nov. 16, 2010 (DE) ..... 10 2010 044 011

(51) Int. Cl.

| | |
|---|---|
| ***B25D 17/00*** | (2006.01) |
| ***B25D 17/26*** | (2006.01) |
| ***B25D 17/24*** | (2006.01) |
| ***B25D 17/06*** | (2006.01) |

(52) U.S. Cl.

CPC ..... *B25D 17/26* (2013.01); *B25D 17/06* (2013.01); *B25D 17/24* (2013.01); *B25D 2217/0019* (2013.01); *B25D 2222/57* (2013.01); *B25D 2250/345* (2013.01)

(58) Field of Classification Search

CPC ..... B25D 17/00; F16J 15/32
USPC ..... 173/200, 208, 210, 211, 212
See application file for complete search history.

(56) References Cited

U.S. PATENT DOCUMENTS

| | | | | | |
|---|---|---|---|---|---|
| 922,130 | A | * | 5/1909 | Goetze | 277/612 |
| 3,496,840 | A | * | 2/1970 | Dorney et al. | 92/85 R |
| 3,969,989 | A | * | 7/1976 | Maurer et al. | 92/85 R |
| 4,385,665 | A | * | 5/1983 | Knoll | 173/162.1 |
| 4,476,941 | A | * | 10/1984 | Buck et al. | 173/117 |
| 4,609,135 | A | * | 9/1986 | Elliesen | 227/130 |
| 4,932,480 | A | * | 6/1990 | Golsch | 173/210 |
| 5,353,689 | A | * | 10/1994 | Bolt et al. | 92/85 R |
| 5,454,573 | A | * | 10/1995 | Nijland | 277/606 |
| 5,536,021 | A | * | 7/1996 | Boehmer et al. | 277/615 |
| 5,692,758 | A | * | 12/1997 | Wikstrom | 277/591 |
| 5,730,263 | A | * | 3/1998 | Grundei et al. | 188/322.18 |

(Continued)

FOREIGN PATENT DOCUMENTS

| | | |
|---|---|---|
| DE | 10294312 T5 | 9/2004 |
| DE | 60303406 T2 | 9/2006 |

(Continued)

OTHER PUBLICATIONS

Deutsches Patent-und Markenamt, Official communication in Application No. 10 2010 044 011.6. dated Oct. 17, 2011 (5 pages).

(Continued)

*Primary Examiner* — Nathaniel Chukwurah
(74) *Attorney, Agent, or Firm* — McAndrews, Held & Malloy, Ltd.

(57) ABSTRACT

A hand-held machine tool is provided. The hand-held machine tool includes a striking element that is accelerated along a working axis, and a guide for the striking element. A cushioning damper limits a motion of the striking element along the working axis and has an elastic damping ring. The damping ring has grooves running on at least one face side radial to the working axis.

19 Claims, 3 Drawing Sheets

(56) References Cited

U.S. PATENT DOCUMENTS

| | | | | |
|---|---|---|---|---|
| 5,921,556 | A * | 7/1999 | Bauman et al. | 277/560 |
| 5,996,708 | A * | 12/1999 | Gerold | 173/211 |
| 6,145,727 | A * | 11/2000 | Mukoyama et al. | 227/130 |
| 6,227,308 | B1 * | 5/2001 | Ghode et al. | 173/93 |
| 6,675,908 | B1 * | 1/2004 | Frauhammer et al. | 173/48 |
| 6,845,983 | B1 * | 1/2005 | Suggs et al. | 277/314 |
| 7,032,638 | B2 * | 4/2006 | Herbelleau et al. | 152/527 |
| 7,032,683 | B2 * | 4/2006 | Hetcher et al. | 173/1 |
| 7,828,663 | B2 * | 11/2010 | Saeki et al. | 464/46 |
| 2002/0139551 | A1 * | 10/2002 | Mewes | 173/114 |
| 2005/0263308 | A1 * | 12/2005 | Chang | 173/210 |
| 2008/0217040 | A1 * | 9/2008 | Loeffler et al. | 173/201 |
| 2008/0296034 | A1 * | 12/2008 | Braun | 173/4 |

FOREIGN PATENT DOCUMENTS

| | | | |
|---|---|---|---|
| EP | 0663270 | A1 | 7/1995 |
| JP | 2005040880 | A | 2/2005 |
| WO | 03024671 | A2 | 3/2003 |
| WO | 2004007149 | A1 | 1/2004 |
| WO | 2007141080 | A1 | 12/2007 |

OTHER PUBLICATIONS

European Search Report, EP 11 18 5226, mailed Feb. 22, 2012.

* cited by examiner

HAND-HELD MACHINE TOOL

RELATED APPLICATIONS

The present application claims priority to German Patent Application DE 10 2010 044 011.6, filed Nov. 16, 2010, and entitled "Handwerkzeugmaschine" ("Hand-Held Machine Tool"), the entire content of which is incorporated herein by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a hand-held machine tool, especially a hand-held machine tool for chiseling or drilling.

BRIEF SUMMARY OF THE INVENTION

A hand-held machine tool according to an embodiment of the present invention has a striking element that is accelerated along a working axis and a guide for the striking element. For example, the striking element can be a pneumatically excited or intermediate striking element of a pneumatic impact tool. A cushioning damper limits a motion of the striking element along the working axis and has an elastic damping ring. The cushioning damper can be provided for stopping a motion of the striking element in one striking direction and/or for stopping a motion of the striking element opposite the striking direction after a rebound. The cushioning damper can be provided to stop the striking element if this moves beyond a position planned for it, e.g. with a blank impact. The damping ring has grooves running on at least one face side radial to the working axis. Lubricants that, among other things, can improve a sliding of the striking element in the guide can creep into pockets between the damping ring and the guide. The grooves make possible an escape of the lubricants from the pockets, if the damping ring is compressed during an impact of the striking element.

A hand-held machine tool according to an embodiment of the present invention has a striking element that is accelerated along a working axis, a guide for the striking element and a cushioning damper. The cushioning damper limits a motion of the striking element along the working axis and has an elastic damping ring that is supported on the mating surface of the guide with a contact surface of the guide. Between the elastic sealing ring and the guide, channels are provided that run radially and/or axially with respect to the working axis. The channels can be formed of recesses in the damping ring and/or grooves in the mating surface of the guide. The recesses can be designed, e.g., as narrow, steep grooves or wider, flat arches.

One embodiment provides that the grooves divide the contact surface of the face side into several separate segments. The grooves can assume a percentage of the surface between about 5% and 15% of the face side. The grooves lead to a weakening of the elastic damping ring and thus of its service life. It has been recognized with a percentage of the surface from about 5% to 15%, the benefit of the grooves outweighs their disadvantages. The grooves can have a depth between about 5% and 10% of the dimension of the damping ring along the working axis.

One embodiment provides that the damping ring is formed of plastic, e.g. elastomers from the class of hydrated acrylnitrile butadiene rubber. The plastic must especially not become completely fully soaked with the lubricants, e.g. grease or oil, since otherwise the plastic becomes hard and non-elastic. The surface that is enlarged due to the grooves may increase the problem of creeping of the lubricants in the elastic damping ring.

One embodiment provides that the guide has a sleeve that can slide along the working axis and the sleeve is prestressed along the working axis by an elastic damping ring. The sleeve can have at least one contact surface partially oriented in the direction of the working axis for a radially-projected bead of the striking element. The sleeve serves as a backdrop for the striking element and distributes the forces uniformly into the elastic damping ring. The moving sleeve can be tensioned between two elastic damping rings, which have grooves that both run radially with respect to the working axis.

One embodiment provides that the elastic damping ring has knobs that project in radial direction. The knobs are suitable to prevent the damping ring from turning and migrating in the guide.

BRIEF DESCRIPTION OF SEVERAL VIEWS OF THE DRAWINGS

The following description explains the invention using exemplary embodiments and figures. In the figures.

Elements that are the same or have the same function are indicated with the same reference numbers in the figures, unless otherwise indicated.

DETAILED DESCRIPTION OF THE INVENTION

Figure 1:
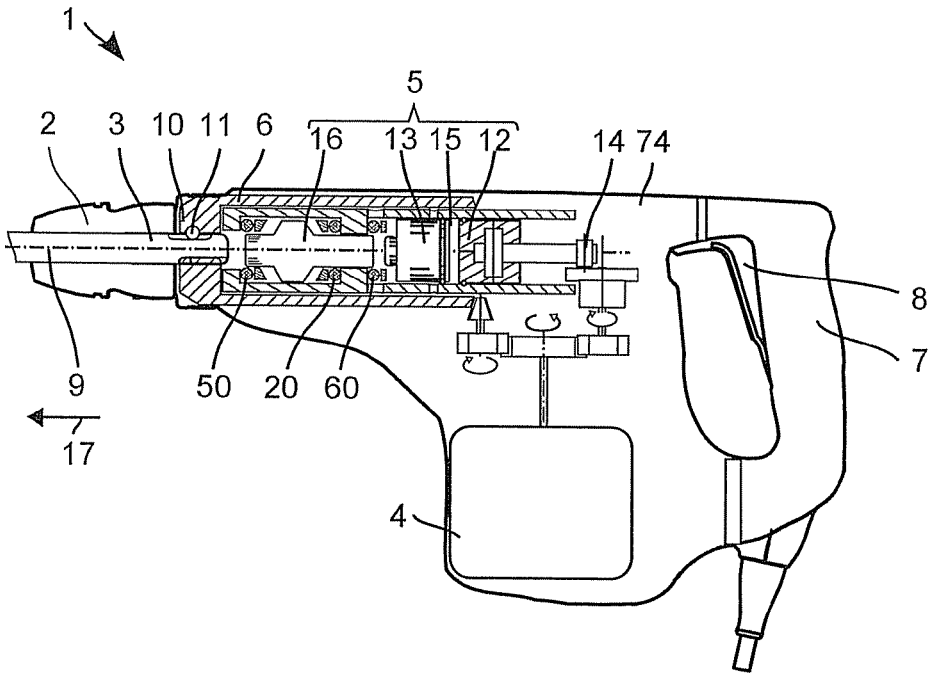
FIG. 1 shows a hammer drill formed in accordance with an embodiment of the present invention.

FIG. 1 shows a hammer drill 1 formed in accordance with an embodiment of the present invention schematically. The hammer drill 1 has a tool holding fixture 2, in which a boring tool 3 can be used. A motor 4 forms a primary drive of the hammer drill 1, which drives an impact tool 5 and an output shaft 6. A user can guide the hammer drill 1 using a handle 7 and put the hammer drill 1 in operation using a system switch 8. In operation, the hammer drill 1 turns the boring tool 3 continuously around a working axis 9 and in this process can drive the boring tool 3 into a substrate along the working axis 9. During the striking, the output shaft 6 can additionally turn the boring tool 3 around the working axis 9.

The tool holding fixture 2 has a holding sleeve 10, in which one end of the boring tool 3 can be inserted. Locking elements 11 in the holding sleeve 10 secure the boring tool 3 against falling out. The holding sleeve 10 has an inner non-rotation-symmetrical contour that is form-fitting with the boring tool, which transfers a torque from the holding sleeve 10 to the boring tool 3. In the holding sleeve 10, pegs or spheres 11 can be provided, for example, that extend radially inward.

The impact tool 5 is, for example, a pneumatic impact tool 5. For example, a bulb-shaped exciter 12 and, for example, a bulb-shaped striking element 13 are guided in the impact tool 5 along the working axis 9. The exciter 12 can also be cup-shaped. The exciter 12 is linked to the motor 4 by a cam 14 or a finger and forced into a periodic linear motion. A pneumatic spring formed by a pneumatic chamber 15 between exciter 12 and striking element 13 (striking piston), couples a motion of the striking element 13 to the motion of the exciter 12. The striking element 13 can strike directly at the back end of the boring tool 3 or transfer part of its pulse to the boring tool 3 by way of an essentially resting intermediate striking element 16 (anvil).

In operation, the intermediate striking element 16 is pressed by the boring tool 3 along the working axis 9 opposite a striking direction 17 against a machine-side stop 18. The striking element 13 drives the intermediate striking element 16, together with the boring tool 3, in striking direction 17 a distance forward in striking direction 17. Depending on the substrate, the boring tool 3 and the striking element 13 experience a rebound, which is absorbed by the stop 18. A cushioning damper 20 and the stop 18 reduce the peak load during rebound. Rebounds can also occur if a user lifts the drill hammer 1 from the substrate. The intermediate striking element 16 is bound in striking direction 17 on a tool-side stop 21 and is reflected by this to the machine-side stop 18.

Figure 2:
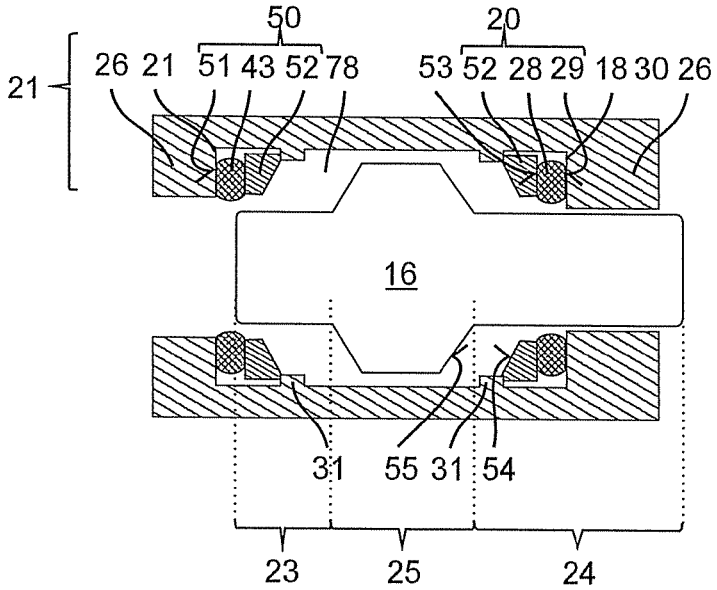
FIG. 2 shows a cut-out from FIG. 1.

FIG. 2 shows an exemplary guide 22 of the intermediate striking element 16 of FIG. 1 in detail. The intermediate striking element 16 can have a shape that is rotation-symmetrical with respect to the working axis 9. A tool-side section 23 and/or a machine-side section 24 of the intermediate striking element 16 are prismatic, e.g. designed so they are cylindrical. The intermediate striking element 16 has a bead 25 that projects radially with respect to the prismatic sections 23, 24, which is preferably arranged between them along the working axis 9. Guide 22 has one or more sleeve-shaped sections 26, which are precisely fitted to the sections 23, 24, surround them radially and guide them along the working axis 9. The sleeves 26 can also form the machine-side stop 18 and the tool-side stop 21, which limit a motion of the intermediate striking element 16 along the working axis 9 in cooperation with the projecting bead 25. The sleeves 26 are preferably fastened on a machine housing of the drill hammer 1.

The cushioning damper 20 is mounted on the machine-side stop 18. The cushioning damper 20 comprises an elastic ring-shaped damper 28 of plastic, e.g. synthetic rubber, hydrated acryl nitrile butadiene rubber. The damping ring 28 preferably lies with one face side 29 turned away from the intermediate striking element 16 on a mating surface 30 of the sleeve 26. The damping ring 28 can be installed in the guide 22 with radial pre-stress and/or fastened using clamping bodies 31, e.g. snap rings, along the working axis 9.

Figure 3:
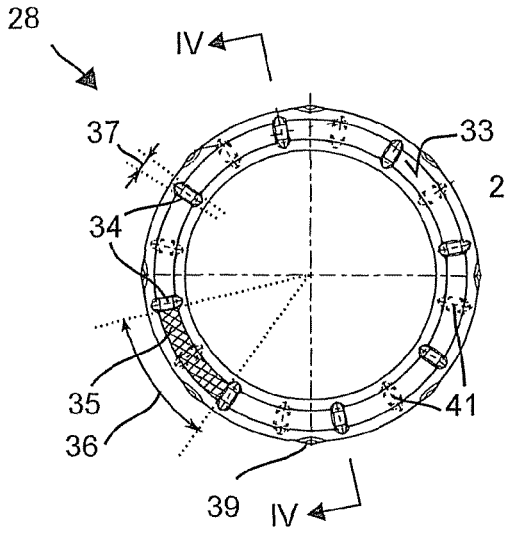
FIGS. 3 and 4 show a damping ring formed in accordance with an embodiment of the present invention.
Figure 4:
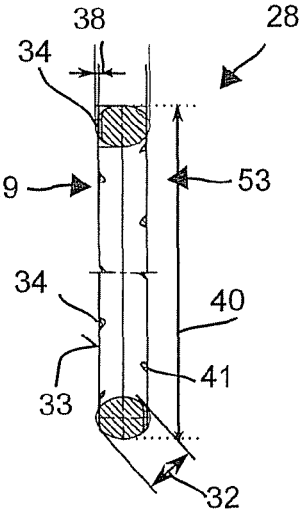

FIG. 3 shows the damping ring 28 in a top view on the face side 29, which contacts the sleeve 26. FIG. 4 shows a cross section in plane IV-IV. The damping ring 28 can have a base element with an essentially uniform cross-section diameter 32, i.e. circular cross section along the circumference. The curved face side 29 can be flatted to a partially flat contact surface 33. The flat contact surface 33 can contact the sleeve 26 uniformly over a large surface. Grooves 34 that run radially (perpendicular to the working axis 9) divide the contact surface 33 into several segments 35 (indicated as shaded area). The grooves 34 can be arranged at the same angular distances around the working axis 9. It has proven to be advantageous if the angular distances 36 between the grooves 34 are less than about 30 degrees. The grooves 34 form channels that run radially, i.e. perpendicular to the working axis 9, between the damping ring 28 and the sleeves 26, on which the damping ring 28 contacts. Lubricants that have been collected in cavities between the damping ring 28 and the guide 22 can escape through the channels in the direction of the working axis 9 when the damping ring 28 is compressed. The otherwise incompressible lubricants thus have no negative effect or only a slight amount on the elastic compression of the damping ring 28.

The surface area of the contact surface 33 is reduced about 5% to 15% by the grooves 34, i.e. in comparison to a damping ring 28 that has the same construction except for the grooves 34. In the example shown, the total of 8 grooves 34 have a width 37 of about 2.5 millimeters and the circumference of the damping ring 28 is approximately 240 millimeters. The width 37 of the grooves 34 can lie in a range from about 2 millimeters to 4 millimeters, which can result in, on one hand, an adequately uniform introduction of force into the damping ring 28 during a compression, and, also an adequately low capillary action for the fluids flowing through the grooves 34. The number of grooves 34 can be adapted to the size of the damping ring 28, in order to adapt the totaled surface area of all grooves 34 to approx. 5% to 15% of the face side.

The grooves 34 preferably have a depth 38 (dimension along the working axis 9) from about 0.5 to 2.0 millimeters. The cross sectional diameter 32 of the damping ring 28 may be about 10 to 20 times as large. Lubricant that creeps between the damping ring 28 and the guide 22 can escape through the grooves 34 during a compression of the damping ring 28.

On the outer radial circumference of the damping ring 28, radially projecting knobs 39 can be provided. The knobs 39 have a slight elevation, e.g., from about 1% to 2% of the average outer diameter 40 of the damping ring 28. By means of the knobs 39, the damping ring 28 can be installed into the preferably cylindrical guide 22 with slight radial pre-stress.

The damping ring 28 can also have tool-side grooves 41 on a second face side 42 oriented perpendicular to the working axis 9, which can be designed similar to the machine-side grooves 34. The tool-side grooves 41 and the machine-side grooves 34 can be arranged at an angular offset with respect to each other around the working axis 9.

A second cushioning damper 50 can be mounted on the tool-side stop 21, which is constructed similar to the cushioning damper 20. Another damping ring 43 of the second cushioning damper 50 can contact with its face side 51 in striking direction 17 oriented to the tool-side stop 21.

A further development of the cushioning damper 20 provides for a metal disk 52. The metal disk 52 lies on the damping ring 28 on its face side 53 turned toward the bead 25 and can move along the working axis 9. The disk 52 can protect the damping ring 28 against wear. In one version, the face side 54 of the disk 52 pointing toward the intermediate striking element 16 and the surface 55 of the bead 25 turned toward the face side 54 are designed as precisely-fitting mating pieces.

Another cushioning damper 60 of a construction type described above can be used as a stop for the striking element 13 acting in the striking direction 17.

Figure 5:
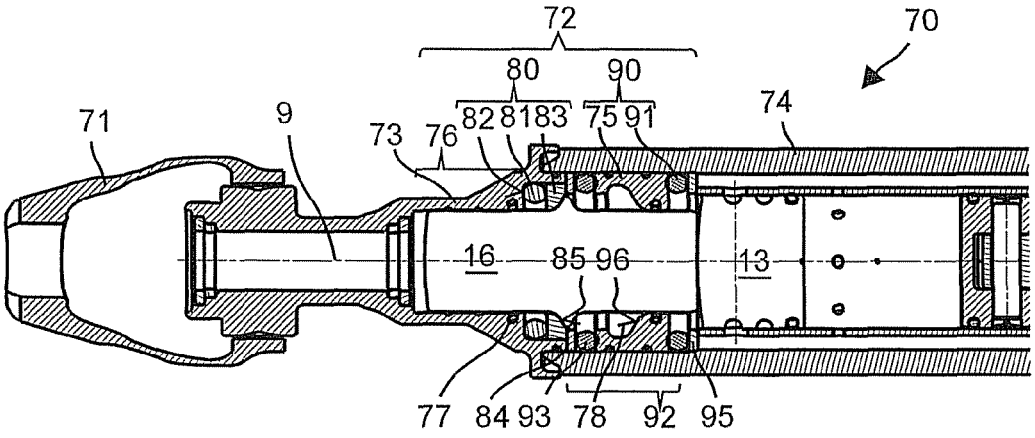
FIG. 5 shows an impact tool formed in accordance with an embodiment of the present invention.

FIG. 5 shows a cutout of another impact tool 70 formed in accordance with an embodiment of the present invention, which is designed as a tool exclusively for chiseling. A clip 71 can surround a collar of the tool for locking. A drive of the intermediate striking element 16 can occur as in the previous embodiments. Additional embodiments may include a drive of the intermediate striking element 16 by a compressed-air-driven pneumatic impact tool. For example, instead of a motor-driven exciter 12, by way of valves, a tool-side face side and a face side turned away from the tool, of the striking element 13, are stressed alternately with compressed air. In another embodiment, the striking element 13 or the intermediate striking element 16 can be accelerated by a propellant charge or electrodynamic forces.

A guide 72 for the intermediate striking element 16 has a first sleeve 73, which is tightly connected to the housing 74, and a second sleeve 75, which is guided so it moves along the working axis 9. The first sleeve 73 surrounds the circumference of the front cylindrical section 76 of the intermediate striking element 16 in a flush manner. Little play between the first sleeve 73 and the intermediate striking element 16 allows the intermediate striking element 16 a motion along the working axis 9. A sealing ring 77 can be installed in the first sleeve 73, in order to reduce the penetration of dust into the impact tool along the intermediate striking element 16.

The first sleeve 73 and the second sleeve 75 limit the motion of the intermediate striking element 16 along the working axis 9. The bead 25 of the intermediate striking element 16 can move in a hollow space 78 between the two sleeves 73, 75. In the example, the first sleeve 73 forms a stop in the direction toward the tool; the second sleeve 75 forms a machine-side stop.

A cushioning damper 80 for stopping the intermediate striking element 16 in striking direction 17 is placed on the first sleeve 73 along the working axis 9. The first cushioning damper 80 has a first damping ring 81 that is installed in the hollow space 78. One face side 82 of the damping ring 81 contacts a stop surface of the first sleeve 73 pointing opposite the striking direction 17. A metallic disk 83 can contact another face side of the first damping ring 81 and forms a part of the first cushioning damper 80. The metallic disk 83 is preferably pre-stressed by the first damping ring 81 against a radial projection 84 on the guide 72. A contact surface 85 of the metallic disk 83 pointing toward the bead 25 of the intermediate striking element 16 preferably has a shape complementary to the shape of the bead 25. For driving the intermediate striking element 16 forward in the striking direction 17, the bead 25 impacts on the metallic disk 83 and the impact is damped by the first damping ring 81.

A second cushioning damper 90 for stopping a motion of the intermediate striking element 16 opposite the striking direction 17 is formed by the second sleeve 75 and a second damping ring 91. The second sleeve 75 is mounted inside the housing 74 so it can be guided in motion along the working axis 9. In the example shown, the housing 74 has a pipe-shaped section 92, within which the second sleeve 75 lies. The second sleeve 75 is mounted along the working axis 9 between a second damping ring 91 and a third damping ring 93, which supports itself on the guide 94. The guide 94 can provide here for corresponding stops 95 projecting radially with respect to the working axis 9. Instead of the third damping ring 93, the moving sleeve 75 can also be supported directly on the housing 74. The moving sleeve 75 preferably has a contact surface 96 complementary to the shape of the bead 25. After the rebound from the front, first cushioning damper 80, the bead 25 can stop on the moving sleeve 75. The second damping ring 91 is compressed and damps the motion of the intermediate striking element 16. Sealing rings on one radial inner surface and on one radial outer surface of the second sleeve 75 prevent creeping of dust along the intermediate striking element 16 and between the second sleeve 75 and the housing 74 in the impact tool.

The damping rings 81, 91, 93 are preferably designed as O-rings, which have radially-running grooves 34 on at least one side. The O-ring can be designed according to the previous examples. The groove 34 runs essentially perpendicular to the working axis 9. The depth of the grooves 34 is selected in such a way that with a compression of the damping ring 91, these grooves 34 are not closed. A depth of about 0.5 millimeters to 2.0 millimeters proves to be adequate for the rebound from the intermediate striking element 16 that occurs, if the damping ring 91 is only slightly weakened by the number and width of the grooves 34. A portion of the grooves 34 on the face side of the damping ring 91 should be less than about 15% for this. The grooves 34 can be provided on one side, on one face side or on both sides on opposite face sides. Alternatively or additionally, grooves in the stops 95 that run radially can be provided. In this case, uniform channels form between the elastic damping ring 91 and the stops 95 that the damping ring 91 contacts, by which lubricant can escape. In this embodiment, the elastic ring can also be designed without grooves. The grooves that run radially in the stops 95 are preferably sized equally to the grooves 34 described above.

The first damping ring 81 and the optional third damping ring 93 can also be designed as O-rings with radial grooves 34.

Figure 6:
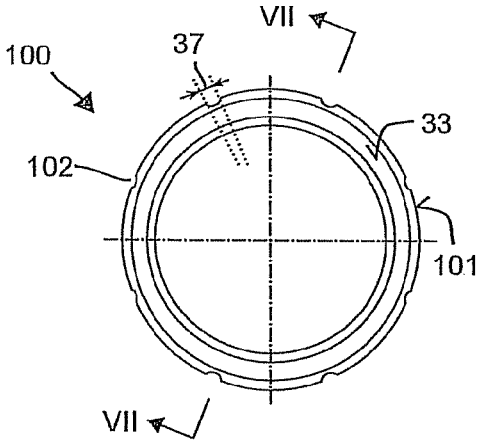
FIGS. 6 and 7 show a damping ring formed in accordance with an embodiment of the present invention.
Figure 7:
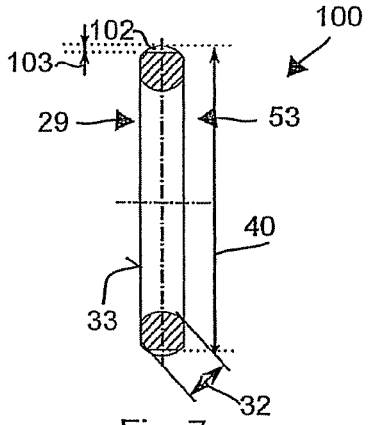

FIGS. 6 and 7 show another embodiment of a damping ring 100 for use, for example, in the impact tool 5 described. The damping ring 100 can be designed as an O-ring with a largely circular shape, i.e. a generally consistent outer diameter 40, and a largely circular cross section, i.e. a generally constant cross-section diameter 32. One face side 29 of the damping ring 100 can be slightly flattened for a flat contact surfaces 33 along a working axis 9.

Grooves 102 that run along the outer circumference 101 are put in axially, i.e. along the working axis 9. A number and width 37 of the grooves 102 can be selected according to the same criteria for the damping ring 28. Because of the low load radially in comparison to axially, the grooves 102 can also be designed with a greater width. A radial depth 103 of the grooves 102 is limited since the damping ring in radial direction, as shown, is also considerably acted on by the axial loading capability. The depth 103 lies in the range between about 5% and 10% of the cross-section diameter 32. A minimum depth 103 of about 0.5 to 2.0 millimeters has proven to be advantageous in order permit a flowing of the viscous lubricant in the grooves 102.

Figure 8:
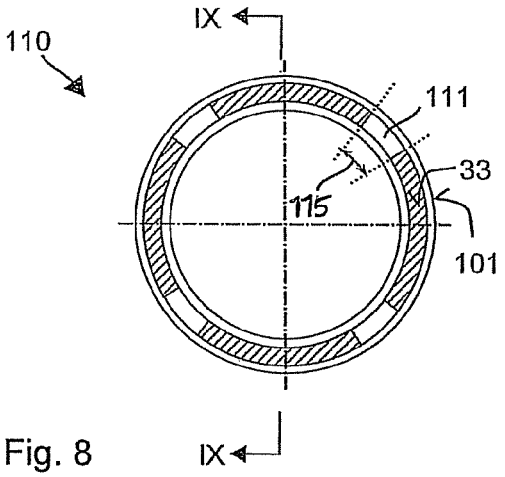
FIGS. 8 and 9 show a damping ring formed in accordance with an embodiment of the present invention.
Figure 9:
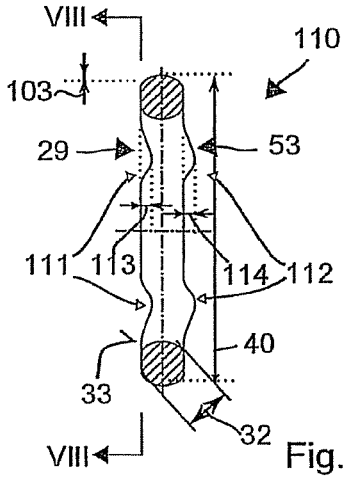

FIGS. 8 and 9 show another embodiment of a damping ring 110. The damping ring 110 can be designed as an O-ring with a largely circular circumference, i.e. a generally consistent outer diameter 40 and a largely circular cross section, i.e. a generally consistent cross section diameter 32. One face side 29 of the damping ring 110 can be slightly flatted for a flat contact surface 33 along a working axis 9.

On the face side 29, concavities 111 are provided, opposite which a convexity 112 is arranged on the other face side 53. An axial depth 113 of the concavity 111 can be the same size of an axial height 114 of the convexity 112. The cross-section diameter 32 is generally consistent along the entire circumference. The damping ring 110 experiences no weakening in the area of the concavity 111.

A width 115 of the concavities 111 and the convexities 112 can be between about 20 degrees and 40 degrees along the circumference 101. The concavities 111 and convexities 112 preferably have facets tilted toward the face side 53 by a maximum of about 40 degrees. During an impact of the striking element, the convexities 112 fill the hollow space of the concavities 111. In the area of steep facets, the forces of gravity that occur exceed the loading capability of the plastics used.

Figure 10:
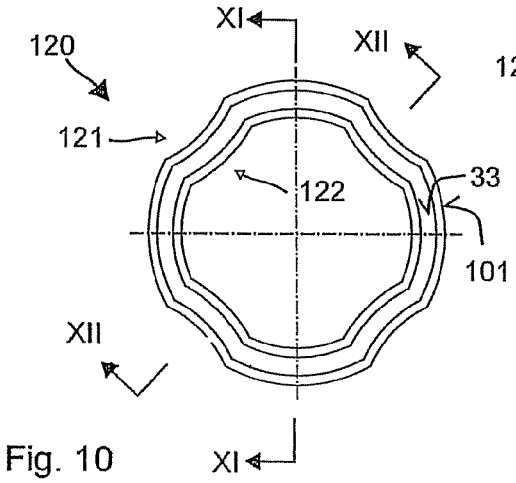
FIGS. 10, 11 and 12 show a damping ring formed in accordance with an embodiment of the present invention.
Figure 11:
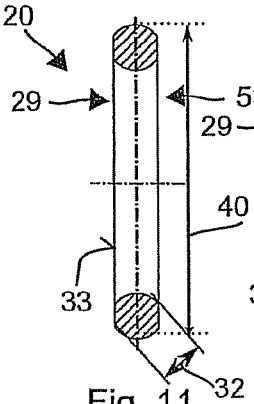
Figure 12:
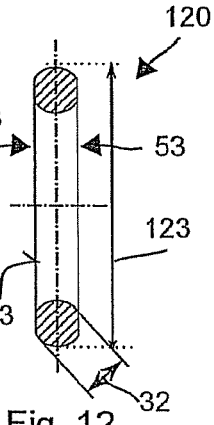

FIGS. 10, 11 and 12 show another embodiment of a damping ring 120. The damping ring 120 has radial concavities 121 in its circumference which are compensated by radial convexities 122 with respect to the working axis 9. A cross-section diameter 32 remains generally constant along the entire circumference.

The invention claimed is:

1. A hand-held machine tool comprising:

a striking element accelerated along a working axis;

a guide for the striking element; and an impact absorber that limits the motion of the striking element along the working axis, the impact absorber including an elastic damping ring;

wherein the damping ring includes first and second face sides, an inner surface extending between the first and second face sides, and an outer circumference extending between the first and second face sides;

wherein the damping ring includes a plurality of recesses that each extend axially across the outer circumference of the damping ring from the first face side to the second face side; and wherein the plurality of recesses are formed by radial concavities opposed by radial convexities.

2. A hand-held machine tool according to claim 1, wherein the plurality of recesses divide a contact surface into several separate segments along the circumference.

3. A hand-held machine too according to claim 1, wherein:

the guide includes a movable sleeve that can move along the working axis; and the movable sleeve is pre-stressed along the working axis by the elastic damping ring.

4. A hand-held machine tool according to claim 3, wherein the movable sleeve has a stop surface for a radially projecting bead of the striking element, the stop surface oriented at least partially in the direction of the working axis.

5. A hand-held machine tool according claim 1, wherein the plurality of recesses have a depth of between about 5% and 10% of the cross-section width of the damping ring.

6. A hand-held machine tool comprising:

a striking element accelerated along a working axis;

a guide for the striking element; and an impact absorber that limits the motion of the striking element along the working axis, the impact absorber including an elastic damping ring;

wherein the damping ring includes first and second face sides, an inner surface extending between the first and second face sides, and an outer circumference extending between the first and second face sides;

wherein the damping ring includes a plurality of recesses that each extend radially across the first face side from the inner surface to the outer circumference; and wherein the plurality of recesses each include a separate concavity on the first face side and a corresponding, separate convexity on the second face side of the damping ring.

7. A hand-held machine tool according to claim 6, wherein the plurality of recesses divide a contact surface of the first face side.

8. A hand-held machine too according to claim 6, wherein:

the guide includes a movable sleeve that can move along the working axis; and the movable sleeve is pre-stressed along the working axis by the elastic damping ring.

9. A hand-held machine tool according to claim 8, wherein the movable sleeve has a stop surface for a radially projecting bead of the striking element, the stop surface oriented at least partially in the direction of the working axis.

10. A hand-held machine tool according claim 6, wherein the plurality of recesses have a depth of between about 5% and 10% of the cross-section width of the damping ring.

11. A hand-held machine tool comprising:

a striking element accelerated along a working axis;

a guide for the striking element; and an impact absorber that limits the motion of the striking element along the working axis, the impact absorber including an elastic damping ring;

wherein the damping ring includes first and second face sides, an inner surface extending between the first and second side faces, and an outer circumference extending between the first and second face sides;

wherein the damping ring includes a plurality of recesses that each extend radially across the first face side of the damping ring from the inner surface to the outer circumference;

wherein the damping ring inner surface is devoid of any recesses; and wherein the guide includes a movable sleeve that can move along the working axis, and the movable sleeve is pre-stressed along the working axis by the elastic damping ring.

12. A hand-held machine tool according to claim 11, wherein the plurality of recesses divide a contact surface of the first face side.

13. A hand-held machine tool according to claim 11, characterized in that the plurality of recesses take up a surface percentage from about 5% to 15% of a contact surface of the first face side.

14. A hand-held machine tool according claim 11, wherein the plurality of recesses have a depth of between about 5% and 10% of the cross-section width of the damping ring.

15. A hand-held machine tool according to claim 11, wherein the movable sleeve has a stop surface for a radially projecting bead of the striking element, the stop surface oriented at least partially in the direction of the working axis.

16. A hand-held machine tool according to claim 11, wherein the movable sleeve is tensioned between two elastic damping rings, both of which have grooves running radially with respect to the working axis.

17. A hand-held machine tool according to claim 11, wherein the elastic damping ring includes knobs projecting perpendicular to the working axis.

18. A hand-held machine tool comprising:

a striking element accelerated along a working axis;

a guide for the striking element; and an impact absorber that limits the motion of the striking element along the working axis;

wherein the guide includes a movable sleeve that can move along the working axis; and wherein the movable sleeve is tensioned between two elastic damping rings at least one of which has grooves running radially with respect to the working axis.

19. A hand-held machine tool according to claim 18, wherein both elastic damping rings have grooves running radially with respect to the working axis.

* * * * *